US009530335B2

(12) United States Patent
Junod

(10) Patent No.: US 9,530,335 B2
(45) Date of Patent: Dec. 27, 2016

(54) AUTOMATON CAPABLE OF WRITING A SIGNATURE

(71) Applicant: Montres Jaquet Droz SA, La Chaux-de-Fonds (CH)

(72) Inventor: François Junod, Ste-Croix (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 121 days.

(21) Appl. No.: 14/638,162

(22) Filed: Mar. 4, 2015

(65) Prior Publication Data

US 2015/0279252 A1 Oct. 1, 2015

(30) Foreign Application Priority Data

Mar. 26, 2014 (EP) ..... 14161665
Apr. 10, 2014 (EP) ..... 14164263

(51) Int. Cl.
*G09F 19/06* (2006.01)
*A63H 13/15* (2006.01)
*G04B 19/00* (2006.01)

(52) U.S. Cl.
CPC ..... *G09F 19/06* (2013.01); *A63H 13/15* (2013.01); *G04B 19/00* (2013.01)

(58) Field of Classification Search
CPC ..... G09F 19/06
USPC ..... 33/18.2
See application file for complete search history.

(56) References Cited

U.S. PATENT DOCUMENTS 512,089 A * 1/1894 Bangerter ..... B43L 13/10 33/18.2
972,920 A * 10/1910 Riggs ..... A63H 13/15 273/161
1,158,068 A * 10/1915 Millman ..... B43L 13/10 33/18.2
1,159,280 A * 11/1915 Schorno ..... B43L 13/10 33/18.2
1,386,332 A * 8/1921 Hendrickson ..... G09F 19/06 33/18.2
1,883,204 A * 10/1932 Whitaker ..... B41J 2/49 33/18.2

(Continued)

FOREIGN PATENT DOCUMENTS

WO 2008034257 A1 3/2008
WO 2009121424 A1 10/2009

OTHER PUBLICATIONS

European Search Report issued in corresponding application 14161665 completed Dec. 23, 2014.

*Primary Examiner* — Christopher Fulton
(74) *Attorney, Agent, or Firm* — Oblon, McClelland, Maier & Neustadt, L.L.P.

(57) ABSTRACT

Automaton capable of writing a signature formed of a series of characters or of stylized signature, wherein the automaton is housed in a volume of a case and operates by means of a system of three cams, wherein two cams encode the movements of a hinged arm carrying a writing instrument in the two dimensions of a writing plane, and wherein a third cam is used to raise or lower the hinged arm perpendicularly to the writing plane, wherein the hinged arm is movable between a first folded position and a second extended position in which the arm transmits to the writing instrument the movements imparted thereto by the system of three cams.

27 Claims, 13 Drawing Sheets

(56) References Cited

U.S. PATENT DOCUMENTS

| | | | | | |
|---|---|---|---|---|---|
| 2,895,258 | A * | 7/1959 | Von Rabenau | A63H 13/15 | 33/18.1 |
| 3,324,762 | A * | 6/1967 | Walter | B43L 13/10 | 33/18.2 |
| 3,325,902 | A * | 6/1967 | Schuman | A63H 13/15 | 33/18.2 |
| 3,654,704 | A * | 4/1972 | Poglein | A63H 13/15 | 33/18.2 |
| 4,003,459 | A * | 1/1977 | Moffatt | B41J 2/49 | 400/18 |
| 4,306,464 | A * | 12/1981 | Mosher | B23Q 35/108 | 33/18.2 |
| 4,769,914 | A * | 9/1988 | Zur | B43L 13/026 | 33/1 M |
| 4,959,037 | A * | 9/1990 | Garfinkel | A63H 13/15 | 33/18.2 |
| 6,564,668 | B1 * | 5/2003 | Bajo | B25J 9/109 | 74/490.05 |

* cited by examiner

AUTOMATON CAPABLE OF WRITING A SIGNATURE

This application claims priority from European Patent applications 14161665.6 of Mar. 26, 2014 and 14164263.7 of Apr. 10, 2014, the entire disclosures of which are hereby incorporated herein by reference.

FIELD OF THE INVENTION

The present invention concerns an automaton capable of writing a signature. More specifically, the present invention concerns an entirely mechanical automaton capable of reproducing the signature of its owner. "Signature" means either a series of characters, or stylised signature.

BACKGROUND OF THE INVENTION

Among the numerous automata made by the Jaquet-Droz family, the "Jaquet-Droz Automata" are four pieces manufactured by Pierre-Jaquet Droz, his son Henri-Louis Jaquet-Droz and Jean Frédéric Leschot between 1767 and 1774; they are The Musician, The Draughtsman and The Writer, the fourth piece is now lost. These three perfectly functional automata can be seen in the Neuchâtel Museum of Art and History in Switzerland, where there is a demonstration of the automata in operation on the first Sunday of every month. These automata can be considered the distant forerunners of modern robots.

The automata were designed and constructed for a dual purpose: on the one hand, to amuse the Royal Courts of Europe, and thereby increase the income of the luxury family watchmaking business; and on the other hand, to rise to a technical challenge by addressing the problems of miniaturisation and synchronisation of elaborate technical systems, by means of complex technical experiments.

The Musician automaton is a female organ player who really plays five different musical melodies. The music is not recorded or played by a musical box, but actually played by the automaton which presses the keys of a genuine miniature organ with her fingers. The musician "breathes" (her chest rises and falls), her eyes follow her hands as they play and her torso moves like a real organist, ending her recital with a bow to the audience.

The Draughtsman built between 1772 and 1774, is a doll capable of drawing four images; a portrait of Louis XV, a royal couple (believed to be Louis XVI and Marie Antoinette), a dog accompanied by the inscription "Mon toutou" (My doggy), and a scene of Cupid driving a chariot pulled by a butterfly. The Draughtsman works by means of a system of cams which encode the movements of the hand in the two dimensions of the sheet, a third cam being used to lift or lower the pencil. The automaton blows on his work occasionally to remove lead pencil dust, a gesture now made redundant by modern lead pencils.

As for The Writer, this is the most complex of the three humanoid Jaquet-Droz Automata. It uses a system similar to that of The Draughtsman to write a series of characters from among a set of 40 different characters.

The present invention is the contemporary expression of this age-old knowledge. Its creators are driven by the same requirement for precision and the same desire for miniaturisation as those which drove the founding fathers. In the present case, the challenge was to create an automaton capable of performing tasks like those accomplished by The Writer automaton, but whose dimensions are reduced to such a point that the automaton can be kept in a jacket pocket or handbag, like a mobile telephone of the "smartphone" type.

To this end, the present invention concerns an automaton capable of writing a signature which is housed in a volume of a case, the automaton operating by means of a system of three cams, two cams encoding the movements of a hinged arm carrying a writing instrument in the two dimensions of a writing plane, and a third cam being used to raise or lower the hinged arm perpendicularly to the writing plane, characterized in that the hinged arm is movable between a first folded position in which it is contained in the volume of the case, and a second extended position in which it is capable of transmitting to the writing instrument the movements imparted thereto by the three cam system.

According to a complementary characteristic of the invention, the arm carrying the writing instrument is pivotally hinged on the case which houses the automaton.

According to another characteristic of the invention, considering the automaton from the base upwards, the cam system includes in succession a lower cam, an intermediate cam and an upper cam, the lower cam encoding the movement of the hinged arm in one of the two dimensions of the writing plane in a pivoting motion in the clockwise and anticlockwise direction, the intermediate cam encoding the movement of the hinged arm in the other dimension of the writing plane in a forward-backward sliding motion, and the upper cam encoding the up-down motion of the hinged arm in a perpendicular direction to the writing plane.

According to yet another characteristic of the invention, the lower cam is kinematically connected to the hinged arm of the automaton by a lower lever which communicates its back-and-forth motions to the hinged arm of the automaton by exerting on the hinged arm a force that is parallel to and remote from a longitudinal axis of symmetry of the hinged arm, the intermediate cam is kinematically connected to the hinged arm of the automaton by an intermediate lever which communicates its back-and-forth motions to the hinged arm of the automaton by exerting on the hinged arm a force that is aligned with the longitudinal axis of symmetry of the hinged arm, and the upper cam is connected to the hinged arm of the automaton by an upper lever which communicates its back-and-forth motions to the hinged arm of the automaton by exerting on the hinged arm a force perpendicular to the writing plane.

According to yet another characteristic of the invention, the automaton is driven by a timepiece movement.

As a result of these characteristics, the present invention provides an automaton capable of writing a signature, typically the signature of its owner, formed either of a series of characters, or of stylised signature, and comprising an arm which carries the writing instrument and which, in a storage position, is concealed in the volume of the case that houses the automaton mechanism. In this respect, the automaton according to the invention differs from the Jaquet-Droz Writer automaton, whose arm is not arranged to be folded away, and offers a compact solution allowing for storage, for example, in a jacket pocket or in a handbag. Further, the fact that, in the storage position, the arm is contained in the volume of the case, avoids the risks of damaging the automaton, and particularly its arm.

Other features and advantages of the present invention will appear more clearly from the following detailed description of an example embodiment of the signature machine according to the invention, this example being given solely by way of non-limiting illustration with reference to the annexed drawing, in which.

The present invention proceeds from the general inventive idea which consists in providing an automaton capable of writing the signature of its owner, formed either of a series of characters, or of stylised signature, miniaturised to the point that it can be stored, for example, in a jacket pocket or in a handbag. To achieve this result, downscaling operations are of course performed and it is proposed to fit the automaton according to the invention with an arm that is movable between a retracted position in which the arm is concealed in the volume of the case which houses the automaton mechanism, and an extended writing position. Thus, in the retracted position, the arm does not protrude from the case, which facilitates storage of the automaton and guards against any risk of damage.

Figure 1:
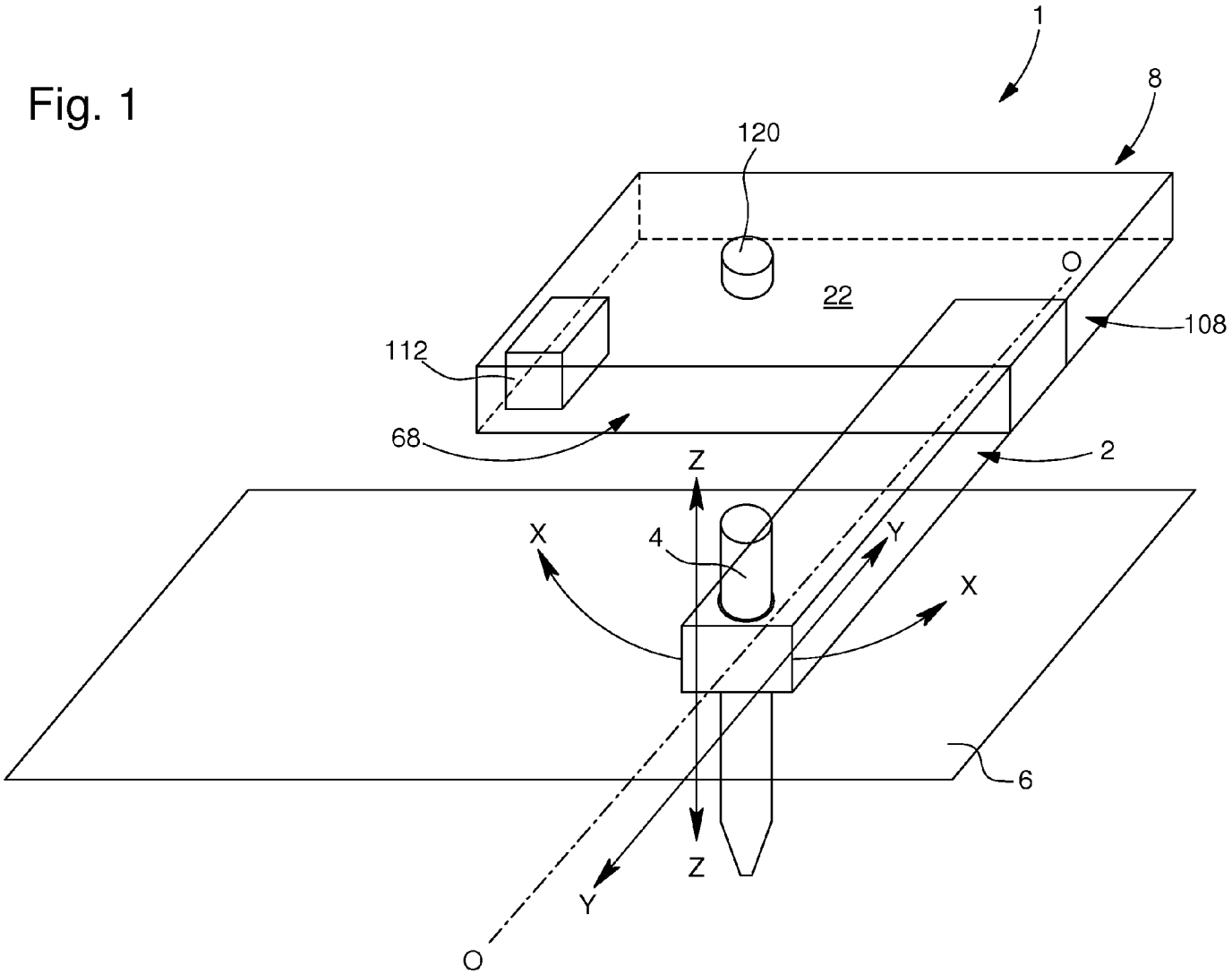
FIG. 1 is a schematic view which illustrates movements, in the two dimensions of a plane and in a third direction perpendicular to the plane, of the arm of the automaton of the invention which carries the writing instrument.

Designated as a whole by the general reference numeral 1, the automaton according to the invention comprises (see FIG. 1), a hinged arm 2 which carries a writing instrument 4 and whose movements in the two dimensions of a writing plane 6 and in a third direction perpendicular to writing plane 6 are illustrated schematically in FIG. 1. More specifically, arm 2 is capable of making, in the two dimensions of writing plane 6, a pivoting motion in a direction "x" in the clockwise and anticlockwise directions, and a forward-backward sliding motion in a direction "y". Arm 2 is capable, finally, of making an up-down motion perpendicular to writing plane 6 in a direction "z".

Automaton 1 according to the invention is housed in a case 8. In the example shown in the drawing, case 8 is of generally parallelepiped shape and its dimensions are similar to those of a "smartphone" type mobile telephone, which permits automaton 1 according to the invention to be stored, for example, in a jacket pocket or in a handbag. It goes without saying however that the shape of case 8 may differ from that of a parallelepiped and that its dimensions can be modified.

Figure 2:
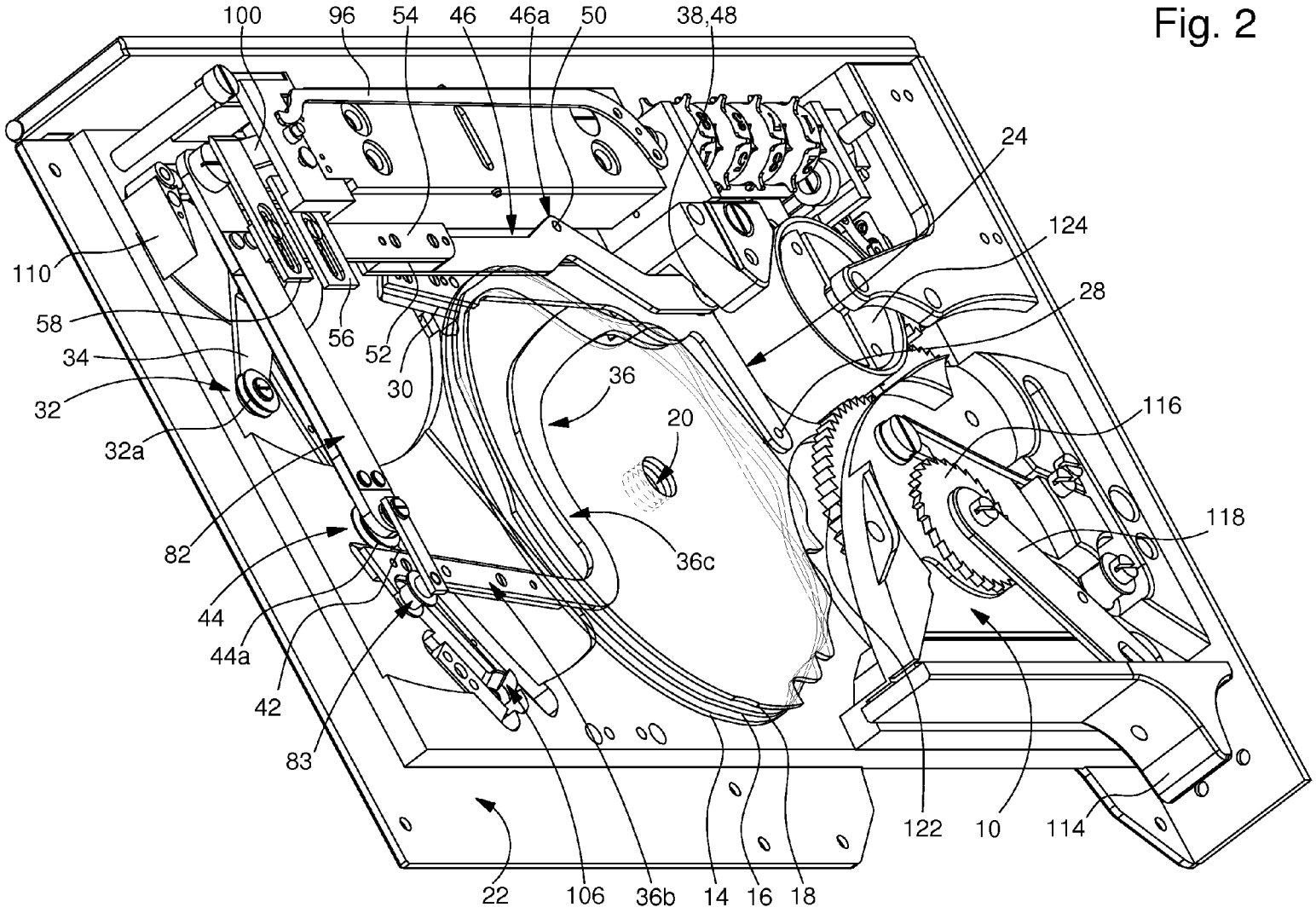
FIG. 2 is a perspective view of the automaton mechanism of the invention, the lower, intermediate and upper levers being visible by transparency through the lower, intermediate and upper cams.
Figure 3:
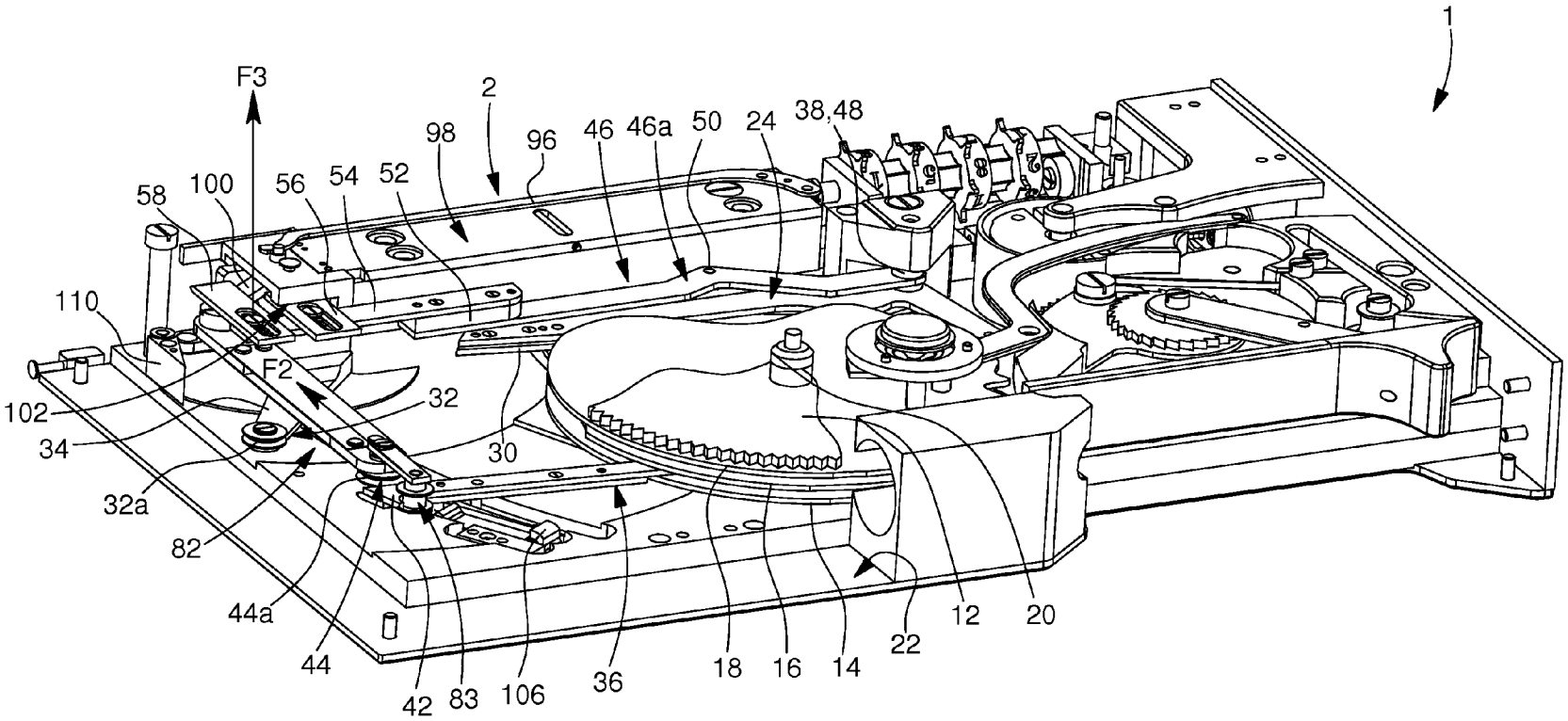
FIG. 3 is a perspective view of the automaton mechanism according to the invention from a different viewing angle to that of FIG. 2.
Figure 4:
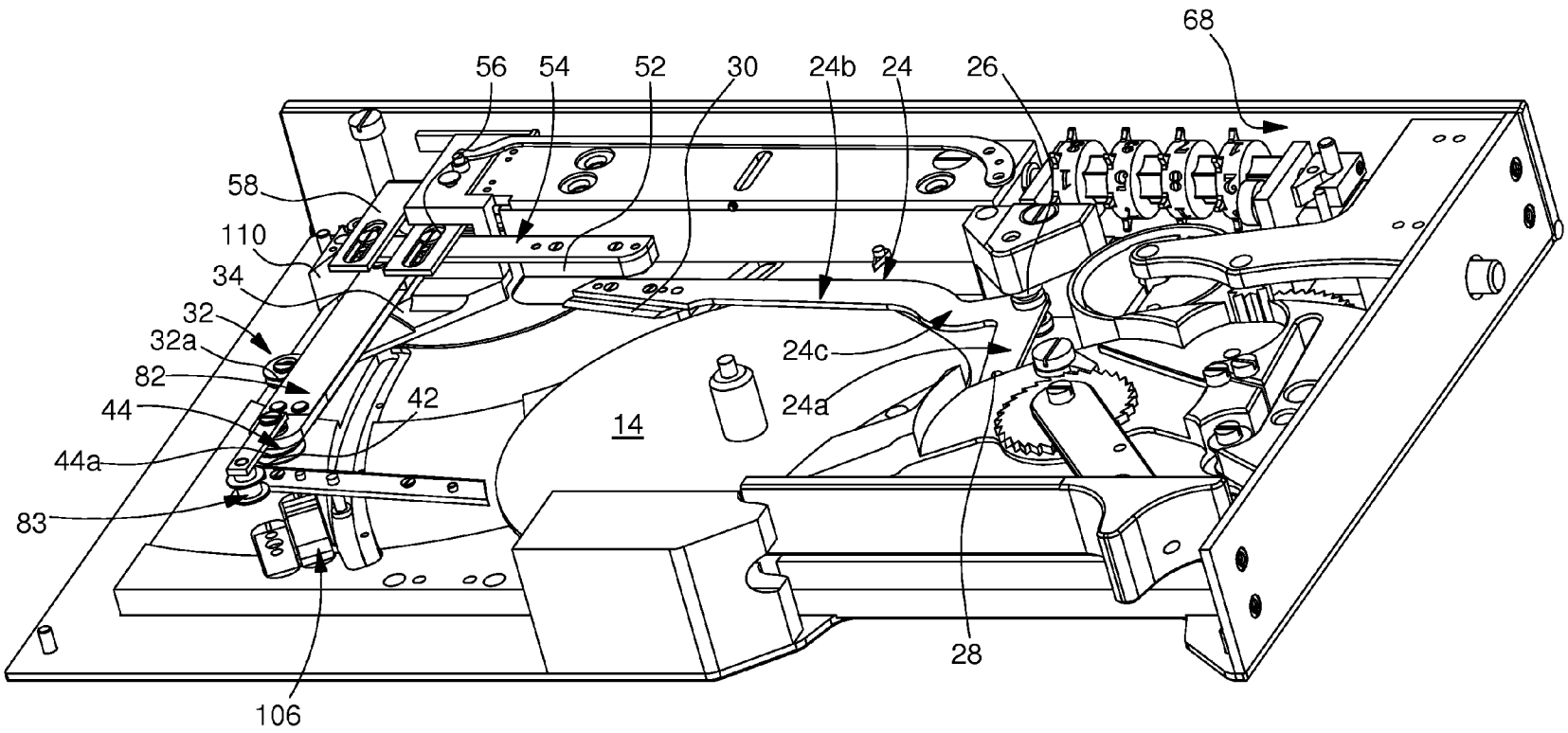
FIG. 4 is a perspective view of the automaton mechanism according to the invention more specifically showing the lower cam and its associated lever.

In the example shown in FIGS. 2 and 3, automaton 1 according to the invention is driven by a timepiece movement comprising a barrel 10. When the spring of barrel 10 is let down, it drives in rotation, via a cam wheel 12, a system of three stepped cams 14, 16 and 18 fixedly mounted on an arbor 20 of cam wheel 12.

Considering automaton 1 according to the invention from its base 22 upwards, the cam system comprises in succession a lower cam 14, an intermediate cam 16 and an upper cam 18.

Lower cam 14 encodes the movement of hinged arm 2 in one of the two dimensions of writing plane 6 corresponding to the pivoting motion in direction "x" in the clockwise and anticlockwise directions.

Intermediate cam 16 encodes the movement of hinged arm 2 in the other dimension of writing plane 6 corresponding to the forward-backward sliding motion in direction "y".

Upper cam 18 encodes the up-down motion of hinged arm 2 in direction "z" perpendicular to writing plane 6.

It is noted in FIG. 3 that lower cam 14 is connected to hinged arm 2 of automaton 1 by a lower lever 24 which takes the form of a thin, flat, L-shaped bar formed of first and second substantially rectilinear portions, respectively 24*a* and 24*b*, connected to each other by a portion 24*c* bent almost at right angles. Lower lever 24 is pivotally hinged about a pivot point 26 located in bent portion 24*c*. At the free end of first rectilinear portion 24*a*, lower lever 24 is provided with an element 28 by which lower lever 24 follows the profile of lower cam 14. This cam follower element 28 is typically a stud which projects under the surface of lower lever 24 and which is fixed thereto for example by riveting. At the free end of second rectilinear portion 24*b*, lower lever 24 is provided with a blade 30 via which lower lever 24 communicates its back-and-forth motions to hinged arm 2 of automaton 1. To this end, blade 30 is horizontal to be capable of penetrating a groove 32*a* of a roller 32 fixed to a support 34 carried by hinged arm 2 remote from its longitudinal axis of symmetry O-O. The preferred choice of a roller 32 is explained by the necessity for blade 30 to move with the least possible friction. Thus, gradually as lower cam 14 rotates, the back-and-forth motions of lower lever 24 are converted, by means of blade 30 abutting against groove 32*a* of roller 32, into a pivoting motion of hinged arm 2 in direction "x" of writing plane 6 in the clockwise and anticlockwise directions. Indeed, blade 30 exerts on hinged arm 2 a force F1 which is parallel to and remote from the longitudinal axis of symmetry O-O of hinged arm 2, such that, under the effect of this force F1, hinged arm 2 pivots in one direction or the other.

Figure 5:
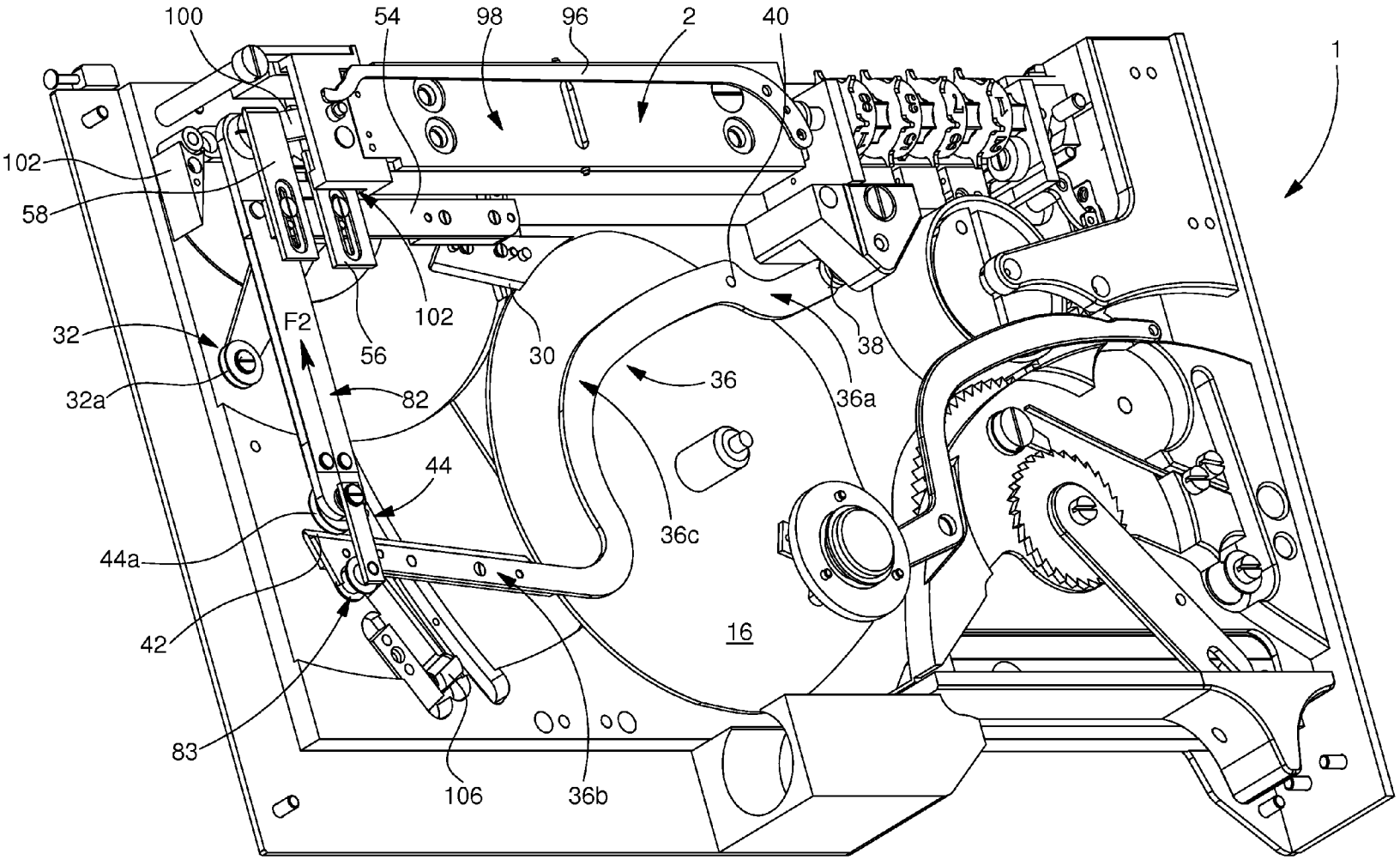
FIG. 5 is a perspective view of the automaton mechanism according to the invention more specifically showing the median cam and its associated lever.

Intermediate cam 16 is connected to hinged arm 2 of automaton 1 by an intermediate lever 36 which (see FIG. 5) takes the form of a thin, flat bar formed of first and second substantially rectilinear portions, respectively 36*a* and 36*b*, connected to each other by a curved portion 36*c*. Intermediate lever 36 is pivotally hinged about a pivot point 38 located at the free end of first rectilinear portion 36*a*. In the area of connection between first rectilinear portion 36*a* and curved portion 36*c*, intermediate lever 36 is provided with an element 40 by means of which intermediate lever 36 follows the profile of intermediate cam 16. This cam follower element 40 is typically a stud which projects under the surface of intermediate lever 36 and which is fixed thereto for example by riveting. At the free end of second rectilinear portion 36*b*, intermediate lever 36 is provided with a blade 42, via which intermediate lever 36 communicates its back-and-forth motions to hinged arm 2 of automaton 1. To this end, blade 42 is horizontal to be capable of penetrating the groove 44*a* of a roller 44 fixed to the rear end of hinged arm 2 in the axial extension thereof. The preferred choice of a roller 44 is explained by the necessity for blade 42 to move with the least possible friction. Thus, gradually as intermediate cam 16 rotates, the back-and-forth motions of intermediate lever 36 are converted, by means of blade 42 abutting against groove 44*a* of roller 44, into a forward-backward sliding motion of hinged arm 2 in direction "y" of writing plane 6. Indeed, blade 42 exerts on hinged arm 2 a force F2 which is aligned with the longitudinal axis of symmetry O-O of hinged arm 2, such that, under the effect of this force F2, hinged arm 2 moves axially.

Figure 6:
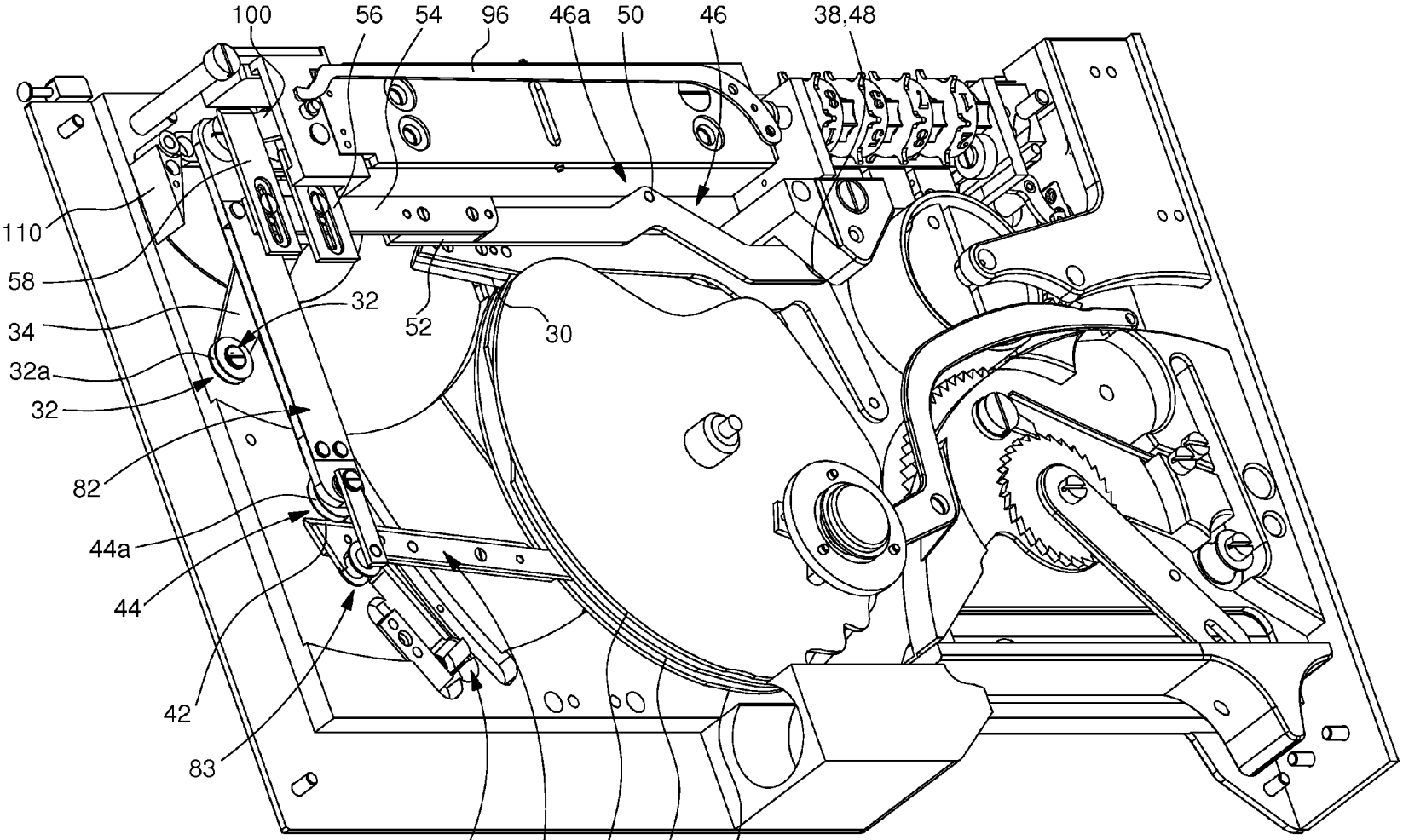
FIG. 6 is a perspective view of the automaton mechanism according to the invention more specifically showing the upper cam and its associated lever.

Upper cam 18 is connected to hinged arm 2 of automaton 1 by an upper lever 46 which (see FIG. 6) takes the form of a substantially rectilinear, thin, flat bar with a locally V-shaped bent portion 46*a*. At one of its free ends, upper lever 46 is pivotally hinged about a pivot point 48. In its bent portion 46*a*, upper lever 46 is provided with an element 50 by means of which upper lever 46 follows the profile of upper cam 18. This cam follower element 50 is typically a stud which projects under the surface of upper lever 46 and which is fixed thereto for example by riveting. At its other free end, upper lever 46 is provided with a shim 52 via which upper lever 46 is rigidly connected to an extension element 54. As revealed by an examination of the drawings, extension element 54 takes the form of a substantially rectilinear, thin, flat bar which, by means of shim 52, can be fixed in the extension of upper lever 46 and in a higher plane than that in which upper lever 46 extends. At its free end, extension element 54 carries a guide finger 56 and a blade 58 which take the form of two separate plates extending substantially perpendicularly to extension element 54 and through which upper lever 46 communicates its back-and-forth motions to hinged arm 2 of automaton 1. Thus, gradually as upper cam 18 rotates, the back-and-forth motions of upper lever 46 are converted into up-down movements of hinged arm 2 in direction "z" perpendicular to writing plane 6 in a manner that will be described in detail below.

Figure 7:
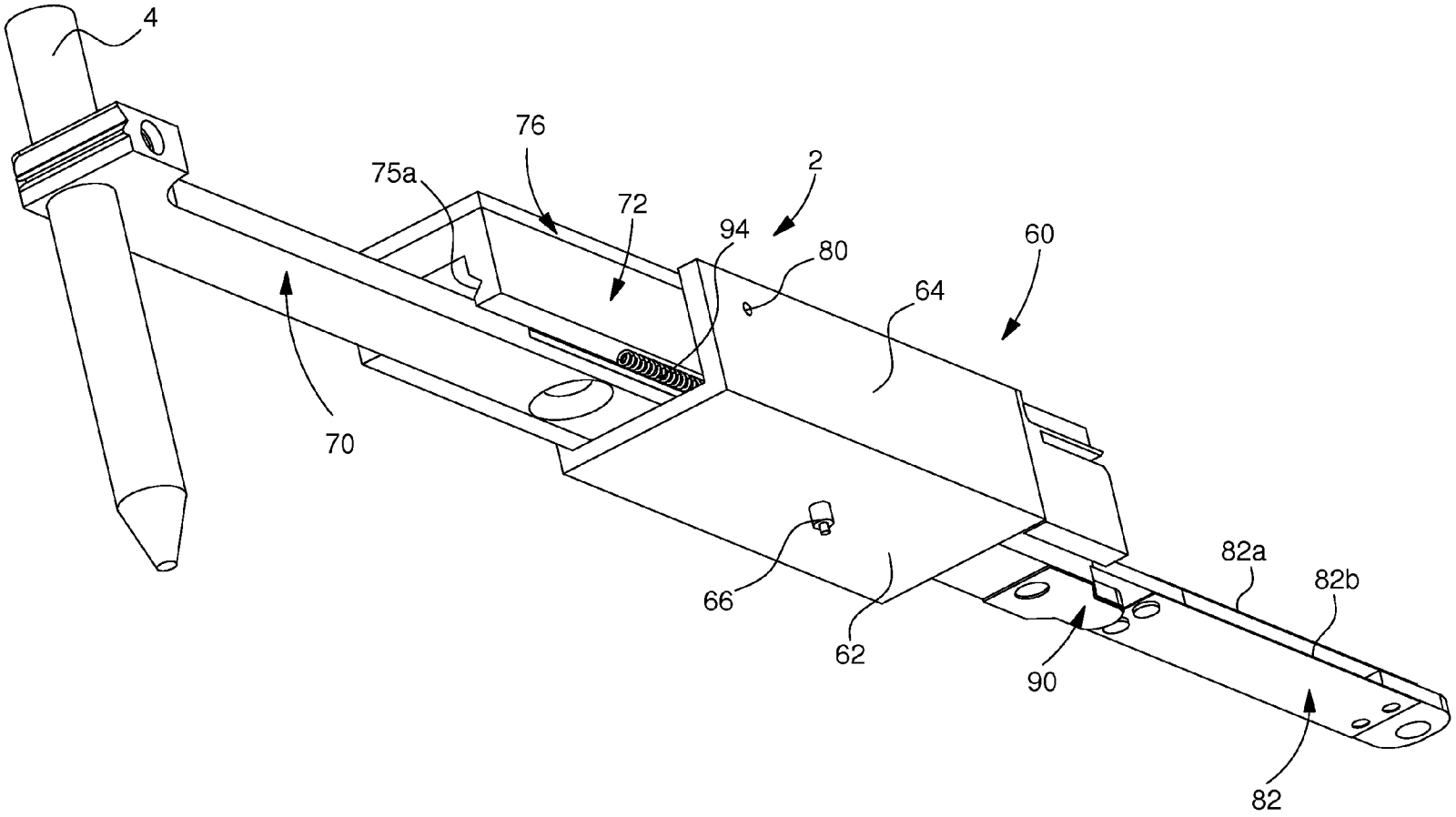
FIG. 7 is a perspective view of the hinged arm according to the invention.
Figure 8:
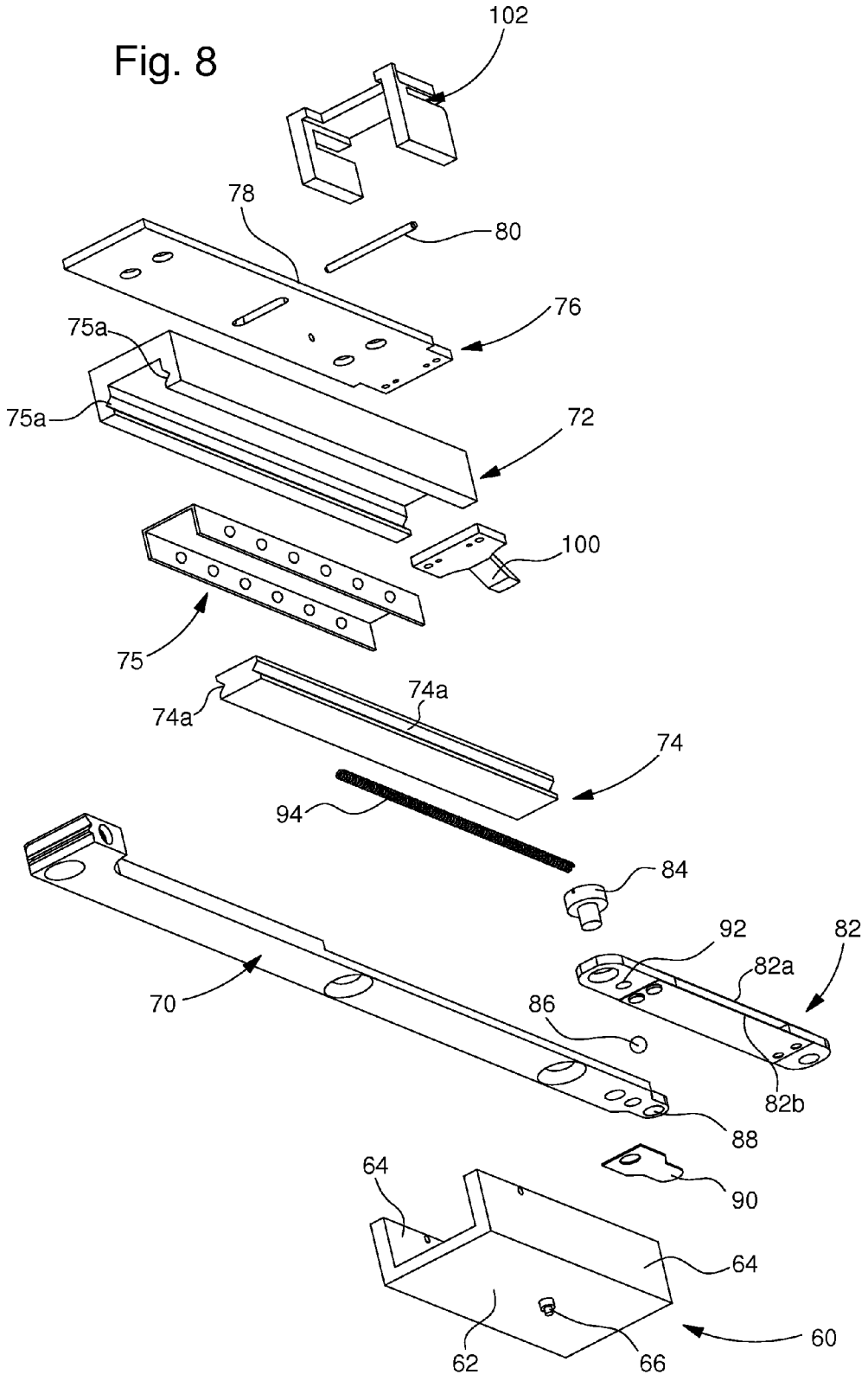
FIG. 8 is an exploded view of the hinged arm of FIG. 7.

Hinged arm 2 of automaton 1 according to the invention includes (see FIGS. 7 and 8) angle piece type frame 60, i.e. formed of a base 62 and two vertical lateral walls 64, which extend remote from each other. This frame 60 is mounted to pivot about a vertical arbor 66 which projects under the surface of frame 60 and is housed inside a corresponding recess provided in base 22 of case 8. Hinged arm 2 can be moved between a first folded position in which it is contained in the volume of case 8, and a second extended position in which it extends substantially perpendicularly to a front surface 68 of case 8. A generally rectilinear plate 70 which carries writing instrument 4 is slidably mounted inside a linear guide 72 via a slide-bar 74 on which plate 70 is fixed. More precisely, slide-bar 74 is slidably mounted inside linear guide 72 via a ball cage 75 which is in turn capable of sliding inside linear guide 72. To achieve this, the balls of ball cage 75 are capable of rolling in V-shaped grooves 74*a* and 75*a* respectively provided on the outer lateral surfaces of slide-bar 74 and on the inner lateral surfaces of linear guide 72. When plate 70 moves, slide-bar 74 moves twice as far relative to ball cage 75. The assembly formed by linear guide 72 and plate 70 which carries writing instrument 4 is carried by a support plate 76 capable of pivoting relative to frame 60. To achieve this, a through hole 78, which extends perpendicularly to the longitudinal axis of symmetry O-O of hinged arm 2 and which permits the passage of a pivot arbor 80, is arranged in the thickness of support plate 76. The assembly formed by linear guide 72 and its support plate 76 therefore has only one degree of freedom relative to frame 60 of hinged arm 2. As a result of this assembly, plate 70 which carries writing instrument 4 has two degrees of freedom relative to frame 60 of hinged arm 2, namely axial and pivotal.

Finally, plate 70 which carries writing instrument 4 is extended by a flexible arm 82, such as a bimetallic strip, formed of two blades 82*a* and 82*b* which extend parallel to and remote from each other. At its free end, flexible arm 82 carries roller 44 whose groove 44*a* is penetrated by blade 42 of intermediate lever 36. Flexible arm 82 is arranged to prevent too much stress being exerted on blade 42. At its free end, flexible arm 82 carries a roller 83, which forms, with flexible arm 82, a cage to guide intermediate lever 36 and thereby prevent any risk of uncoupling between the lever and flexible arm 82.

Plate 70 which carries writing instrument 4 is pivotally hinged on flexible arm 82 by a pivot 84 and is coupled to flexible arm 82 by means of a semi-rigid hinge. In the example shown in the drawing, this semi-rigid hinge is formed of a spring-loaded ball 86 housed in a seat 88 arranged in plate 70 and retained therein by a resilient tab 90. Spring-loaded ball 86 projects partially into a housing 92 arranged in the lower surface of flexible arm 82, opposite seat 88. This semi-rigid hinge, whose role will be explained below, ensures a rigid connection between plate 70 and flexible arm 82 up to a maximum bending value beyond which spring-loaded ball 86 is forced into its seat 88 and permits uncoupling of plate 70 and flexible arm 82.

A first resilient member 94, such as a helical spring, is fixed at one end on plate 70 and at another end on linear guide 72. This first resilient member 94 has the function of forcing, via plate 70 and flexible arm 82, roller 44 against blade 42 and, through reaction, cam follower element 40 against the profile of intermediate cam 16. A second resilient member 96, integral with a bridge 98 of hinged arm 2, forces roller 32 against blade 30 and, through reaction, cam follower element 28 against the profile of lower cam 14.

Figure 9:
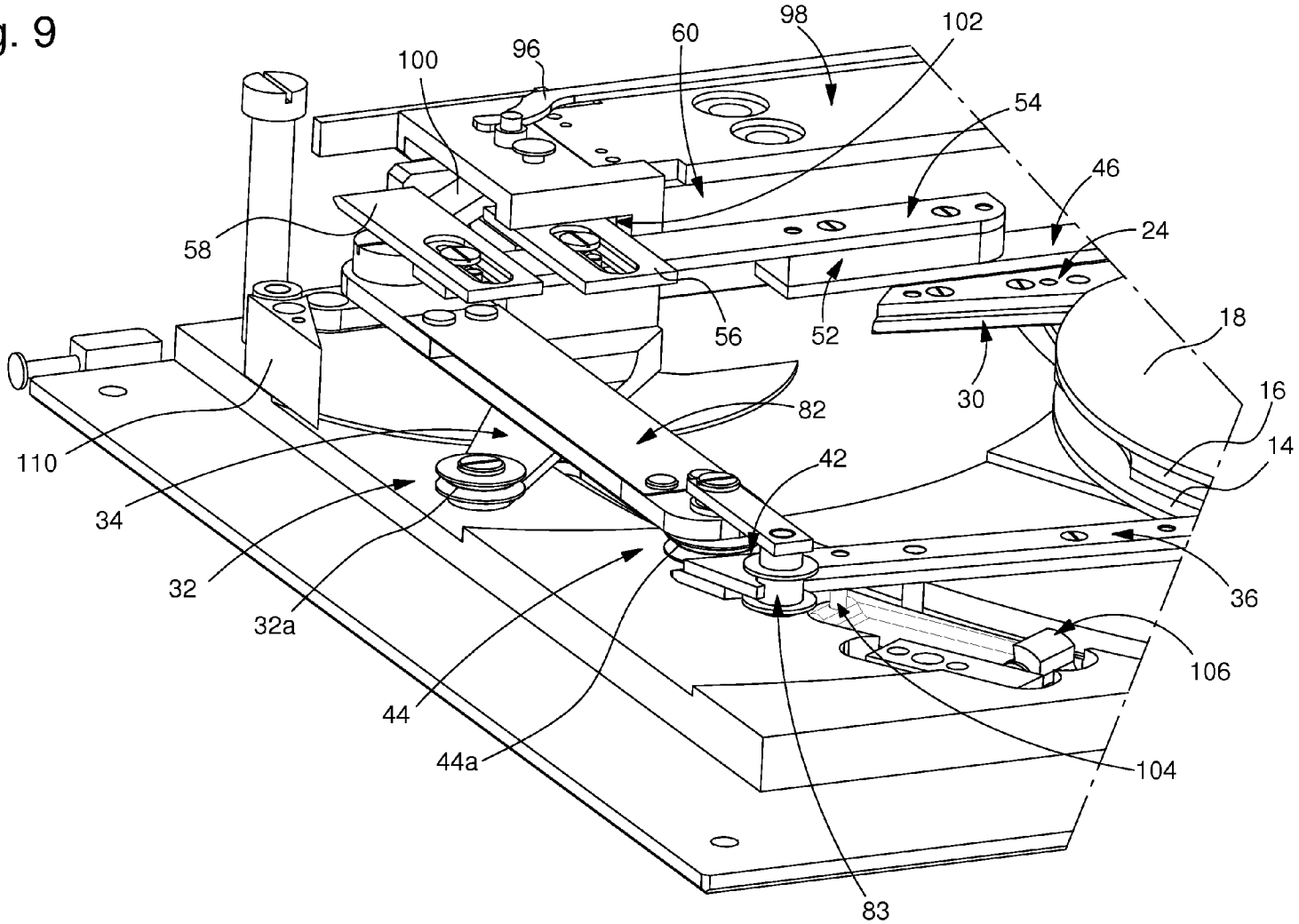
FIG. 9 is a detail perspective view of the automaton mechanism according to the invention which more particularly illustrates the inclined plane by means of which the upper lever controls the movement of the hinged arm in the direction perpendicular to the writing plane.

As shown in FIG. 9, to convert the back-and-forth motions of upper lever 46 into up-down motions of hinged arm 2 in direction "z" perpendicular to writing plate 6, blade 58 carried by extension element 54 of upper lever 46 slides along an inclined plane 100 provided on plate 70 which carries writing instrument 4. Since guide finger 56, also carried by extension element 54, projects into a slot 102 arranged in frame 60 of hinged arm 2, it is immobilised in the vertical direction, so that when blade 58 slides along inclined plane 100, this causes a vertical upward or downward force F3 of plate 70 which carries writing instrument 4.

Figure 10:
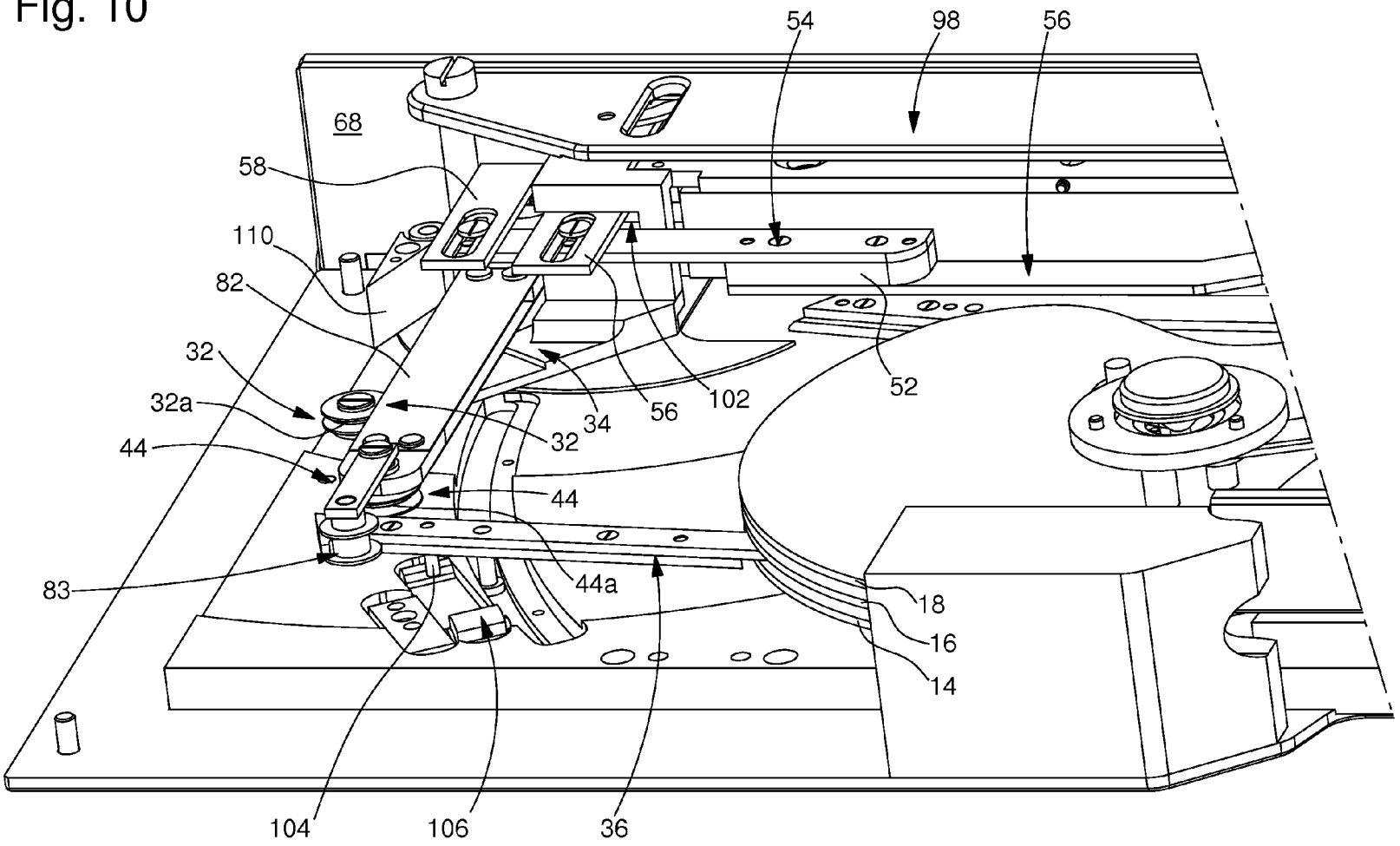
FIG. 10 is a detail perspective view of the automaton mechanism according to the invention more specifically showing the pin actuating the locking lever.
Figure 11:
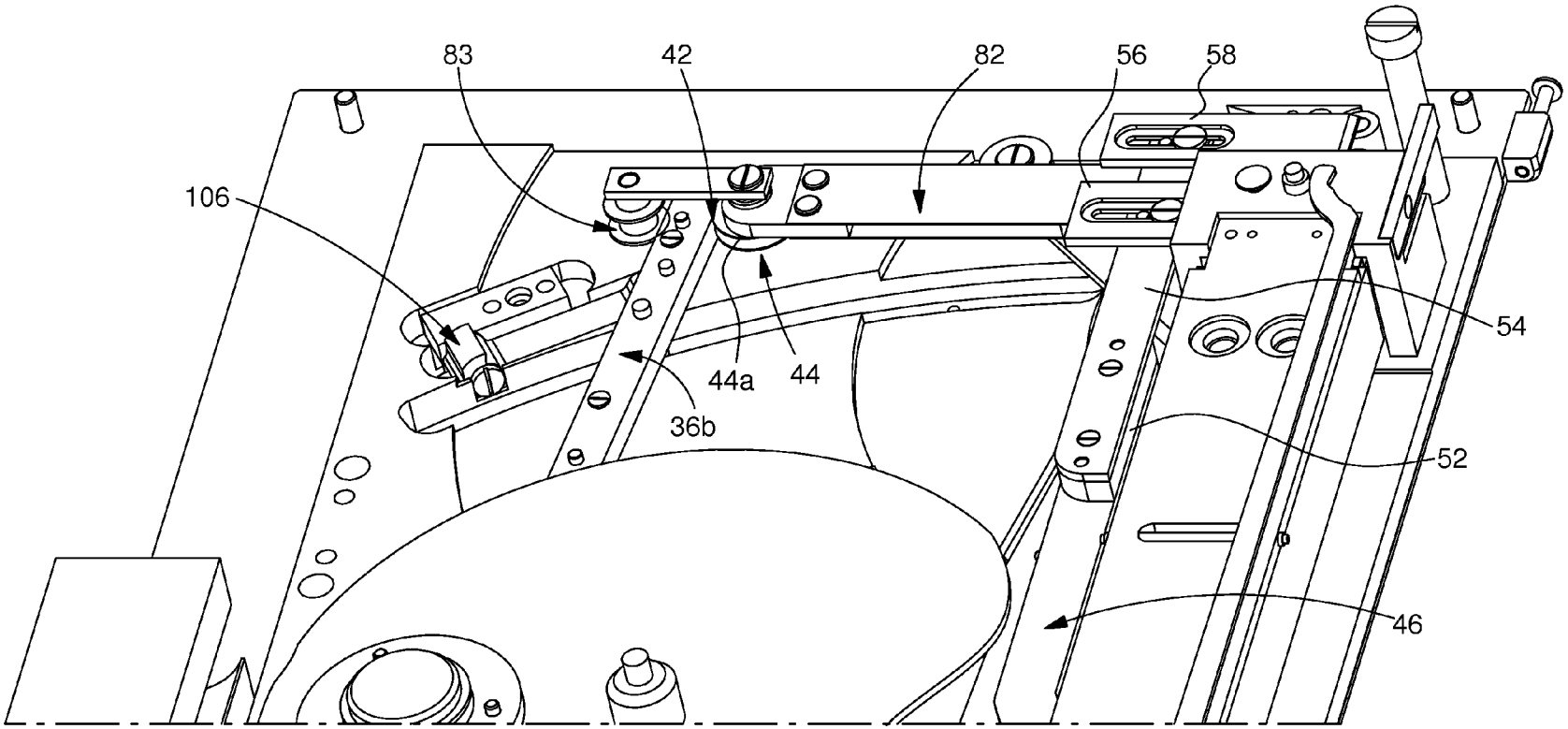
FIG. 11 is an enlarged detail perspective view of the pin actuating the locking lever of FIG. 10.
Figure 12:
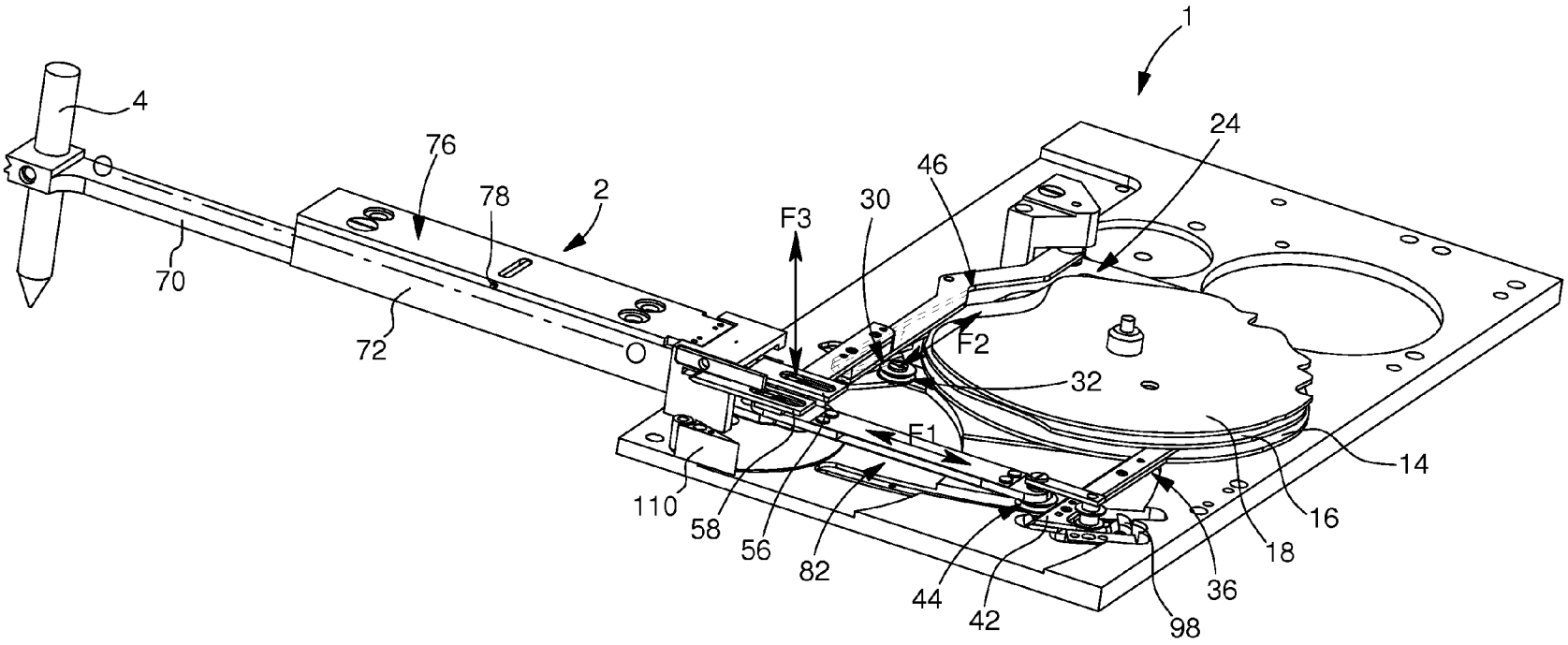
FIG. 12 is a perspective view of the automaton according to the invention, with the hinged arm in the extended position.
Figure 13:
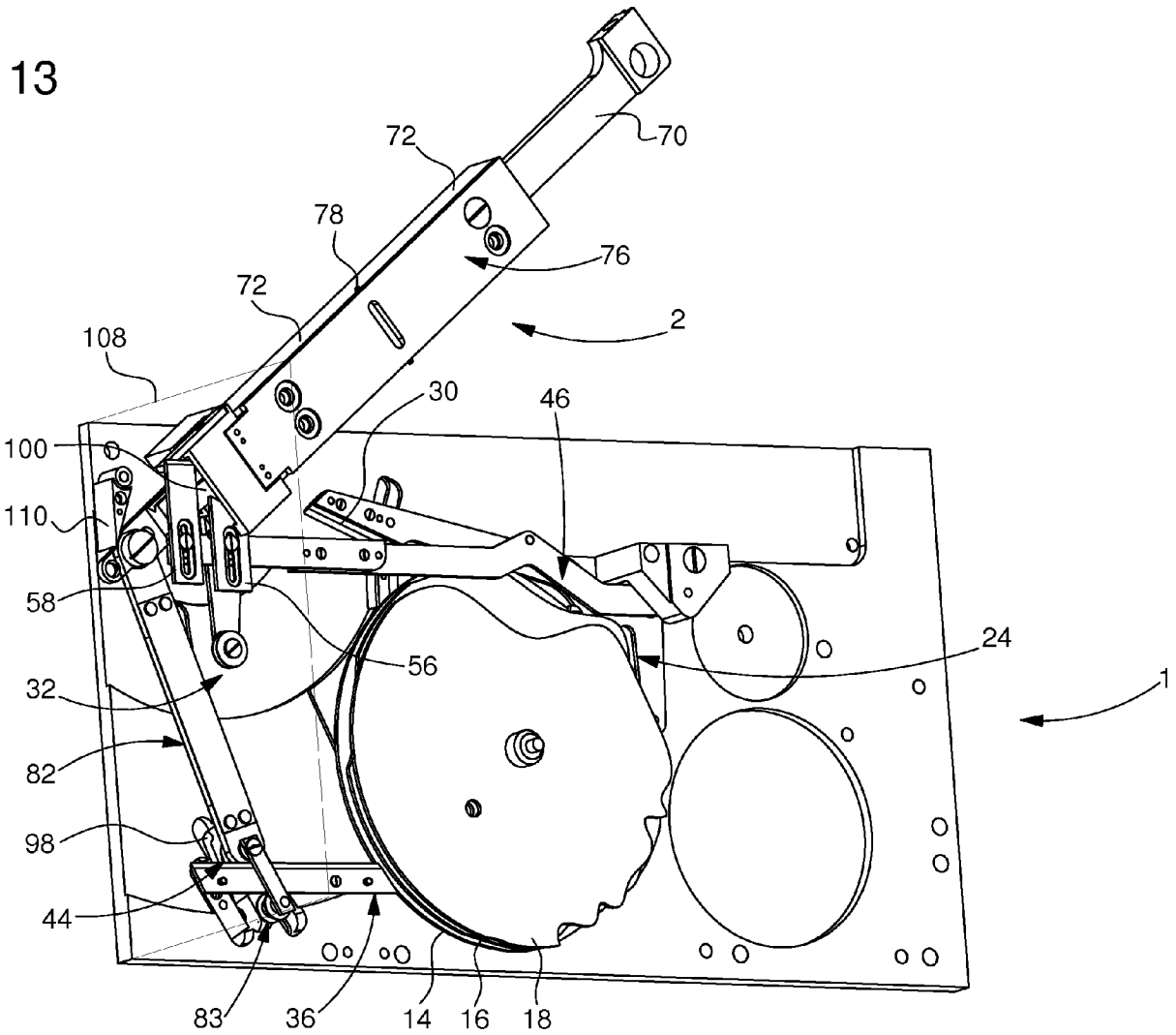
FIG. 13 is a perspective view of the automaton according to the invention, with the hinged arm in a partially folded position.

In the writing position (FIG. 12), hinged arm 2 of automaton 1 extends substantially perpendicularly to the front surface 68 of case 8. When the writing phase is finished and it is desired to store automaton 1, hinged arm 2 must be folded so that it is concealed in the volume of case 8 which houses the mechanism of automaton 1. To achieve this, a thrust is exerted on hinged arm 2 causing it to pivot about its vertical arbor 66 towards the front surface 68 of case 8. At the very start of this pivoting motion, intermediate lever 36 is in an extreme position which is only seen once over the entire perimeter of intermediate cam 16 and which coincides with the smallest radius of intermediate cam 16. Next, when hinged arm 2 of automaton 1 starts to be pushed, intermediate lever 36 moves so that a pin 104, which projects under the surface of intermediate lever 36, causes lifting of a locking tab 106 (see FIGS. 10 and 11). This locking tab 106 will act as a stop surface against which flexible arm 82 will abut. The resulting bending force will cause uncoupling of plate 70, which carries writing instrument 4, and flexible arm 82 in the area of the semi-rigid hinge. Continuing the closing movement of hinged arm 2 of automaton 1 (see FIG. 13), plate 70 will slide along a lateral wall 108 of case 8 and then be guided along an inclined plane 110, which completes the closing movement of hinged arm 2. Hinged arm 2 is held in a locked position by means of a spring-loaded ball locking system. A push button 112 permits the release of hinged arm 2.

As is clear from FIGS. 1 and 2, a winding button 114 connected to ratchet 116 of barrel 10 by a lever 118 allows the spring of barrel 10 to be wound. Winding button 114 is associated with two clicks, the first of these two clicks releasing ratchet 116 to permit winding of the spring of barrel 10 when winding button 114 is pulled, and the second click locking ratchet 16 to prevent the spring of barrel 10 being let down when winding button 114 is released. When release button 120 is pressed, the toothing 122 of barrel 10 transmits the torque to cam wheel 12. An isolator 124 ensures a constant rotational speed of toothing 122 of barrel 10.

It goes without saying that this invention is not limited to the embodiment that has just been described and that various simple modifications and variants can be envisaged by those skilled in the art without departing from the scope of the invention as defined by the annexed claims. It will be understood, in particular, that the automaton according to the invention is capable of reproducing the signature of its owner, whether this signature is formed of a series of characters or formed of stylised signature. This requires only suitable programming of the automaton by an appropriate choice of cams which will control the movement of the hinged arm and consequently that of the writing instrument.

LIST OF PARTS

Directions x, y, z
Longitudinal axis of symmetry O-O
Automaton 1
Hinged arm 2
Writing instrument 4
Writing plane 6
Case 8
Barrel spring 10
Cam wheel 12
Lower cam 14
Intermediate cam 16
Upper cam 18
Arbor 20
Bottom 22
Lower lever 24
First rectilinear portion 24*a*
Second rectilinear portion 24*b*
Bent portion 24*c*
Pivot point 26
Cam follower element 28
Blade 30
Groove 32*a*
Roller 32
Support 34
Force F1
Intermediate lever 36
First rectilinear portion 36*a*
Second rectilinear portion 36*b*
Curved portion 36*c*
Pivot point 38
Cam follower element 40
Blade 42
Groove 44*a*
Roller 44
Force F2
Upper lever 46
Bent portion 46*a*
Pivot point 48
Cam follower element 50
Shim 52
Extension element 54
Guide finger 56
Blade 58
Frame 60
Bottom 62
Vertical lateral walls 64
Vertical arbor 66
Front surface 68
Plate 70
Linear guide 72
Slide-bar 74
Ball cage 75
Support plate 76
Through hole 78
Horizontal pivot arbor 80
Bimetallic flexible arm 82
Roller 83
Pivot 84
Spring-loaded ball 86
Seat 88
Resilient tab 90
Housing 92
Helical spring 94
Second resilient member 96
Bridge 98
Inclined plane 100
Slot 102
Vertical force F3
Pin 104
Locking tab 106
Lateral wall 108
Inclined plane 110
Push-button 112
Winding button 114
Ratchet 116
Lever 118
Release button 120
Toothing 122
Isolator 124

What is claimed is:

1. An automaton capable of writing a signature formed of a series of characters or of stylised signature, wherein the automaton is housed in a volume of a case and operates by means of a system of three cams, wherein two cams encode the movements of a hinged arm carrying a writing instrument in the two dimensions of a writing plane, and wherein a third cam is used to raise or lower the hinged arm perpendicularly to the writing plane, wherein the hinged arm is movable between a first folded position and a second extended position in which the arm transmits to the writing instrument the movements imparted thereto by the system of three cams.

2. The automaton according to claim 1, wherein the hinged arm carrying the writing instrument is pivotally hinged on the case which houses the automaton.

3. The automaton according to claim 2, wherein the hinged arm can be moved between a first folded position in which the hinged arm is contained in the volume of the case, and a second extended position in which the hinged arm extends substantially perpendicularly to a front surface of the case.

4. The automaton according to claim 3, wherein the hinged arm of the automaton comprises a frame mounted to pivot about a vertical arbor on the case, wherein a plate carrying the writing instrument is slidably mounted inside a linear guide, wherein the linear guide is pivotally mounted inside the frame about a horizontal arbor extending perpendicularly to a longitudinal axis of symmetry of the hinged arm.

5. The automaton according to claim 4, wherein a first resilient member is fixed at one end on the plate and at another end on the linear guide.

6. The automaton according to claim 2, wherein the hinged arm of the automaton comprises a frame mounted to pivot about a vertical arbor on the case, wherein a plate carrying the writing instrument is slidably mounted inside a linear guide, wherein the linear guide is pivotally mounted inside the frame about a horizontal arbor extending perpendicularly to a longitudinal axis of symmetry of the hinged arm.

7. The automaton according to claim 6, wherein a first resilient member is fixed at one end on the plate and at another end on the linear guide.

8. The automaton according to claim 1, wherein the hinged arm of the automaton comprises a frame mounted to pivot about a vertical arbor on the case, wherein a plate carrying the writing instrument is slidably mounted inside a linear guide, wherein the linear guide is pivotally mounted inside the frame about a horizontal arbor extending perpendicularly to a longitudinal axis of symmetry of the hinged arm.

9. The automaton according to claim 8, wherein a first resilient member is fixed at one end on the plate and at another end on the linear guide.

10. The automaton according to claim 9, wherein the first resilient member is a helical spring.

11. The automaton according to claim 8, wherein the plate carrying the writing instrument is extended by a flexible arm.

12. The automaton according to claim 11, wherein the plate carrying the writing instrument is pivotally hinged on the flexible arm.

13. The automaton according to claim 12, wherein the plate that carries the writing instrument is coupled to the flexible arm by means of a semi-rigid hinge.

14. The automaton according to claim 13, wherein the semi-rigid hinge comprises a spring-loaded ball, wherein the spring-loaded ball is housed in a seat arranged in the plate and is retained in the seat by a resilient tab, wherein the spring-loaded ball partially projects into a housing arranged in the lower surface of the flexible arm facing the seat.

15. The automaton according to claim 11, wherein the flexible arm is a bimetallic strip.

16. The automaton according to claim 11, wherein, considering the automaton from a base upwards, the cam system includes in succession a lower cam, an intermediate cam and an upper cam, wherein the lower cam encodes the movement of the hinged arm in one of the two dimensions of the writing plane in a pivoting motion in the clockwise and anticlockwise direction, wherein the intermediate cam encodes the movement of the hinged arm in the other dimension of the writing plane in a forward-backward sliding motion, and wherein the upper cam encodes the up-down motion of the hinged arm in a perpendicular direction to the writing plane.

17. The automaton according to claim 16, wherein the lower cam is kinematically connected to the hinged arm of the automaton by a lower lever, wherein the lower lever communicates the back-and-forth motions thereof to the hinged arm of the automaton by exerting on the hinged arm a force that is parallel to and remote from a longitudinal axis of symmetry of the hinged arm, wherein the intermediate cam is kinematically connected to the hinged arm of the automaton by an intermediate lever, wherein the intermediate lever communicates the back-and-forth motions thereof to the hinged arm of the automaton by exerting on the hinged arm a force that is aligned with the longitudinal axis of symmetry of the hinged arm, and wherein the upper cam is connected to the hinged arm of the automaton by an upper lever, wherein the upper lever communicates the back-and-forth motions thereof to the hinged arm of the automaton by exerting on the hinged arm a force perpendicular to the writing plane.

18. The automaton according to claim 17, wherein the lower lever is provided with a blade via which the lower lever communicates the back-and-forth motions thereof to the hinged arm of the automaton, wherein the blade is horizontal to be capable of penetrating a groove of a roller fixed on a support carried by the hinged arm remote from the longitudinal axis of symmetry of the hinged arm.

19. The automaton according to claim 18, wherein the intermediate lever is provided with a blade via which the intermediate lever communicates the back-and-forth motions thereof to the hinged arm of the automaton, wherein the blade is horizontal to be capable of penetrating a groove of a roller fixed to a rear end of the hinged arm in the axial extension thereof.

20. The automaton according to claim 19, wherein the flexible arm carries, at the free end thereof, the roller whose groove is penetrated by the blade comprised in the intermediate lever.

21. The automaton according to claim 16, wherein, at the very start of the folding movement of the hinged arm, the intermediate lever is in an extreme position which is observed only once over the entire perimeter of the intermediate cam and which coincides with the smallest radius of the intermediate cam and wherein, when the hinged arm starts to be pushed, the intermediate lever moves such that a pin projecting under a surface of the intermediate lever causes lifting of a locking tab acting as a stop surface against which the flexible arm will abut, wherein the resulting bending force causes uncoupling between the plate carrying the writing instrument and the flexible arm in the area of the semi-rigid hinge, the plate then sliding along a lateral wall of the case and then being guided along a second inclined plane, which ends the closing movement of the hinged arm.

22. The automaton according to claim 21, wherein the hinged arm is held in a locked position by means of a spring-loaded ball locking system.

23. The automaton according to claim 17, wherein the intermediate lever is provided with a blade via which the intermediate lever communicates the back-and-forth motions thereof to the hinged arm of the automaton, wherein the blade is horizontal to be capable of penetrating a groove of a roller fixed to a rear end of the hinged arm in the axial extension thereof.

24. The automaton according to claim 23, wherein the flexible arm carries, at the free end thereof, the roller whose groove is penetrated by the blade comprised in the intermediate lever.

25. The automaton according to claim 17, wherein a shim enables an extension element to be rigidly fixed in the extension of the upper lever and in a higher plane than that in which the upper lever extends, wherein the extension element carries a guide finger and a blade through which the upper lever communicates the back-and-forth motions thereof to the hinged arm of the automaton.

26. The automaton according to claim 25, wherein the finger and the blade comprise two separate plates extending substantially perpendicularly to the extension element, wherein the finger slides along a first inclined plane provided on the plate that carries the writing instrument, and wherein the guide finger projects into a slot arranged in the frame.

27. The automaton according to claim 1, wherein the automaton is driven by a timepiece movement.

* * * * *